US012324474B2

(12) United States Patent
Bath et al.

(10) Patent No.: US 12,324,474 B2
(45) Date of Patent: Jun. 10, 2025

(54) PROTECTIVE GARMENT ASSEMBLY

(71) Applicant: Zulu Alpha Kilo Inc., Toronto (CA)

(72) Inventors: Vikramjeet Singh Bath, Toronto (CA); Daniel Cummings, Toronto (CA); Asa Alexander Couture Pinisch, King City (CA); Catalina Navarro, King City (CA); Lara Clair, King City (CA); Bartek Zalewski, King City (CA); Chris Pearen, King City (CA)

(73) Assignee: ZULU ALPHA KILO INC., Toronto (CA)

( * ) Notice: Subject to any disclaimer, the term of this patent is extended or adjusted under 35 U.S.C. 154(b) by 106 days.

(21) Appl. No.: 18/298,558

(22) Filed: Apr. 11, 2023

(65) Prior Publication Data

US 2023/0320448 A1 Oct. 12, 2023

Related U.S. Application Data

(60) Provisional application No. 63/329,634, filed on Apr. 11, 2022.

(51) Int. Cl.
*A42B 1/08* (2006.01)
*A42B 3/06* (2006.01)
(Continued)

(52) U.S. Cl.
CPC ..... *A42B 3/069* (2013.01); *A42B 1/08* (2013.01); *A63B 71/10* (2013.01); *A41D 23/00* (2013.01);
(Continued)

(58) Field of Classification Search
CPC ..... A42B 1/08; A42B 1/041; A42B 1/006; A42B 3/0473; A42D 2023/004; A63B 71/10; A63B 71/081
(Continued)

(56) References Cited

U.S. PATENT DOCUMENTS 1,809,511 A * 6/1931 Davis ..... A42B 1/041 132/274
2,624,884 A * 1/1953 Degnon ..... A42B 1/045 2/207
(Continued)

OTHER PUBLICATIONS

The Sardar Co. "A Guide to Different Turban Materials" blog, https://www.thesardarco.com/blogs/blog/a-guide-to-different-turban-materials (Year: 2019).*
(Continued)

*Primary Examiner* — Sally Haden
*Assistant Examiner* — Giao Q T Hoang
(74) *Attorney, Agent, or Firm* — Smart & Biggar LP

(57) ABSTRACT

A protective garment assembly can include an elongate main portion having a length that extends between first and second ends. The main portion can include an upper fabric layer and a lower fabric layer. At least one energy-absorbing layer can be arranged between the upper and lower fabric layers and can extend at least partially between the first and second ends. At least one high-strength strip can be arranged between the upper and lower fabric layers adjacent to the at least one energy-absorbing layer. A plurality of armor elements can be arranged between the upper and lower fabric layers adjacent to the at least one energy-absorbing layer and the at least one high-strength strip.

19 Claims, 20 Drawing Sheets

(51) Int. Cl.

| | |
|---|---|
| ***A63B 71/10*** | (2006.01) |
| *A41D 23/00* | (2006.01) |
| *A42B 1/006* | (2021.01) |
| *A42B 1/041* | (2021.01) |
| *A42B 3/04* | (2006.01) |

(52) U.S. Cl.
CPC ..... *A41D 2023/002* (2013.01); *A42B 1/006* (2013.01); *A42B 1/041* (2013.01); *A42B 3/0473* (2013.01)

(58) Field of Classification Search
USPC ..... 2/11
See application file for complete search history.

(56) References Cited

U.S. PATENT DOCUMENTS 3,039,109 A * 6/1962 Simpson ..... A42B 3/121 2/413
4,491,985 A * 1/1985 Dalton ..... A42B 1/041 2/209.12
4,833,734 A * 5/1989 Der Estephanian ... A41D 20/00 2/22
6,336,220 B1 * 1/2002 Sacks ..... A43B 1/0009 428/116
7,058,989 B2 * 6/2006 Domingos ..... A63B 71/10 2/412
8,739,316 B1 6/2014 Norton
10,130,134 B2 11/2018 Blair
2002/0104150 A1 * 8/2002 Hill ..... A42B 1/041 2/174
2003/0070209 A1 * 4/2003 Falone ..... A43B 19/00 2/463
2014/0007324 A1 1/2014 Svehaug
2015/0257470 A1 * 9/2015 Vito ..... A63B 71/10 2/183
2016/0295935 A1 * 10/2016 Foster ..... A41D 13/05
2018/0007990 A1 * 1/2018 Olivares Velasco ..... G08B 13/19621
2019/0037944 A1 * 2/2019 Tussey ..... A42B 1/049
2021/0106086 A1 * 4/2021 Johnson ..... A42B 1/049

OTHER PUBLICATIONS

"In Search of the Sikh Helmet", www.sikhmuseum.com/helmet/sikhs/misis.html.
"F3 D30 Elbow Guard Inserts", www.foxracing.ca/product/f3-d30-elbow-guard-inserts/26389.html.

* cited by examiner

PROTECTIVE GARMENT ASSEMBLY

CROSS-REFERENCE TO RELATED APPLICATION

This application claims priority to U.S. Provisional Application No. 63/329,634 filed Apr. 11, 2022, the entire contents of which are hereby incorporated herein by reference.

FIELD

The present disclosure relates generally to protective gear for a person's head.

INTRODUCTION

The following paragraphs are not an admission that anything discussed in them is prior art or part of the knowledge of persons skilled in the art.

Helmets are a type of protective gear worn to protect a person's head. Typically, a helmet supplements the skull in protecting the human brain. Helmets are used in various sports (e.g., American football, ice hockey, cycling and skiing), in dangerous work environments (e.g., construction, policing and military applications), and for transportation (e.g., motorcycling).

A turban is a type of headwear based on cloth winding. Turbans can serve as an important religious observance, particularly for members of the Sikh religion. Conventional helmets are generally not compatible with Sikh turbans. To accommodate the religious significance, some jurisdictions exempt Sikhs from wearing motorcycle helmets, for example.

There is need for a garment that can function both as a turban and as protective gear for the wearer's head.

SUMMARY

The following is intended to introduce the reader to the detailed description that follows and not to define or limit the claimed subject matter.

In an aspect of the present disclosure, a protective garment assembly may include: an elongate main portion having a length that extends between first and second ends, the main portion including an upper fabric layer and a lower fabric layer; at least one energy-absorbing layer arranged between the upper and lower fabric layers and extending at least partially between the first and second ends; at least one high-strength strip arranged between the upper and lower fabric layers adjacent to the at least one energy-absorbing layer; and a plurality of armor elements arranged between the upper and lower fabric layers adjacent to the at least one energy-absorbing layer and the at least one high-strength strip.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way.

DETAILED DESCRIPTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below, or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Figure 1:
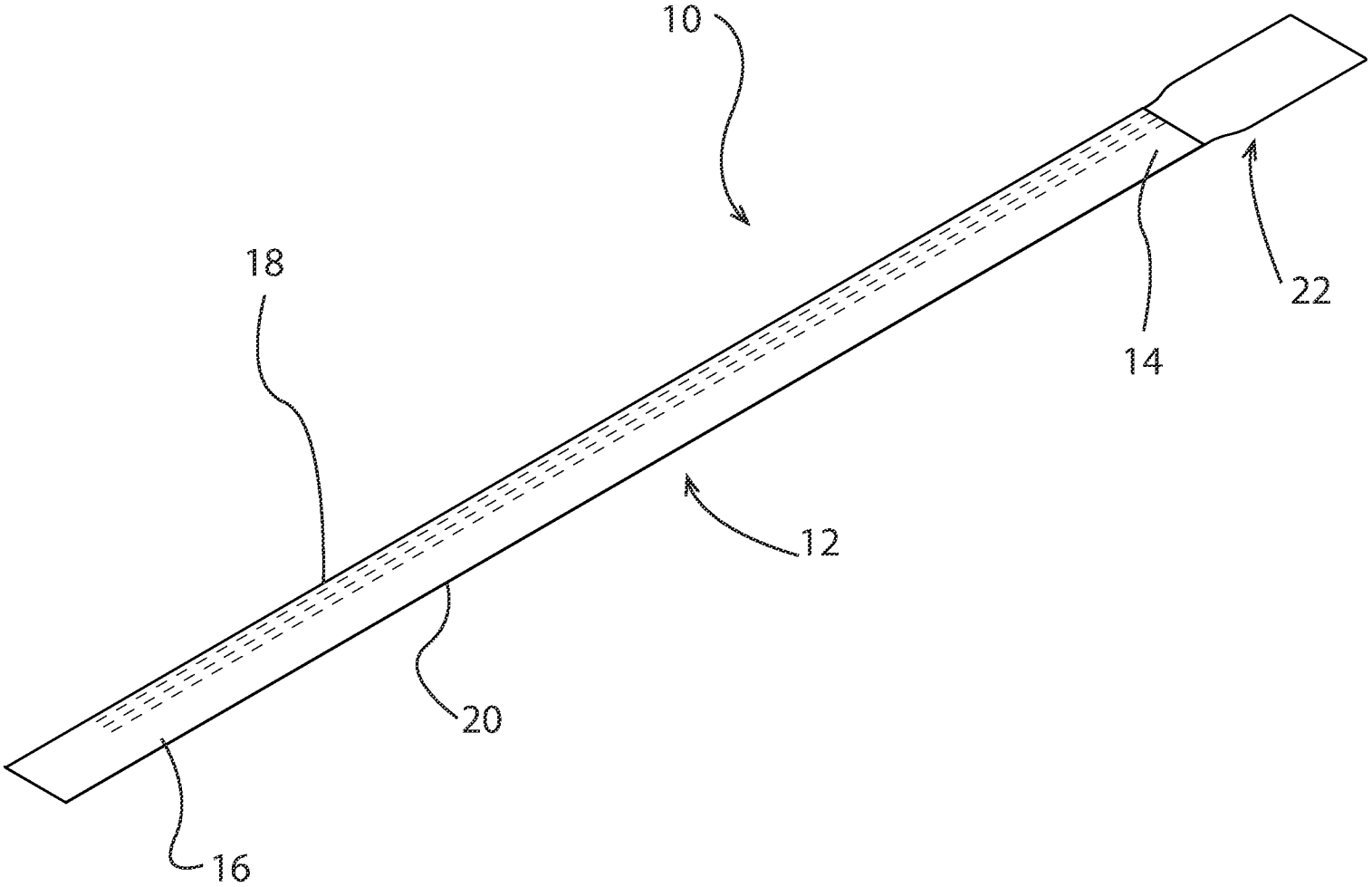
FIG. 1 is a perspective view of an example of a protective garment assembly.

Referring to FIG. 1, a protective garment assembly in an unwrapped configuration is shown generally at reference numeral 10. In accordance with the teachings herein, the assembly 10 can be referred to as the TOUGH TURBAN™ product.

In the example illustrated, the assembly 10 includes an elongate main portion 12 having a length that extends between first and second ends 14, 16, and a width that extends between first and second edges 18, 20.

In the example illustrated, the assembly 10 includes a crown portion 22 secured to the first end 14 of the main portion 12. The crown portion 22 can be secured to the main portion 12 with adhesive and/or stitching.

Figure 2A:
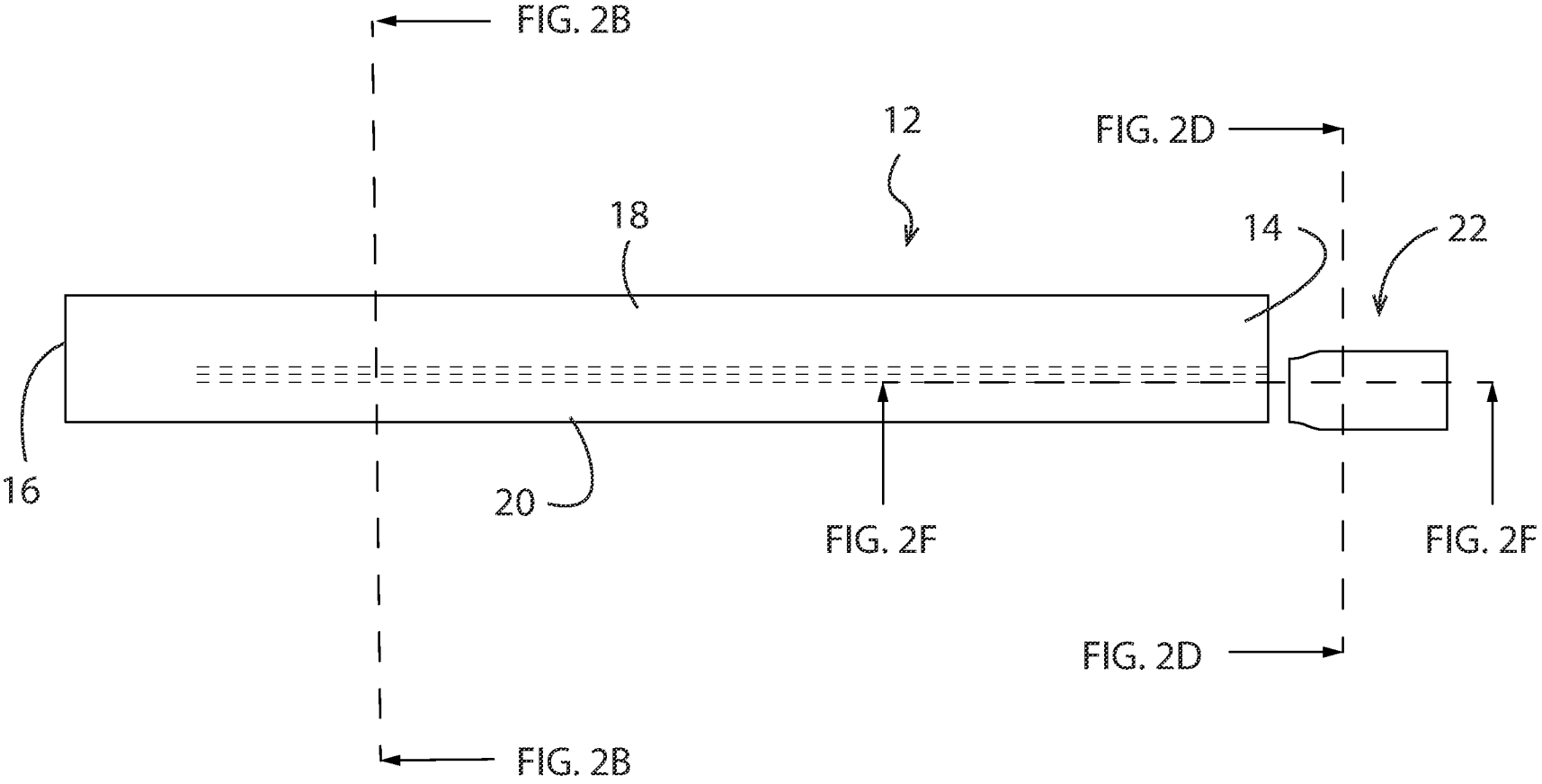
FIG. 2A is a top view of the assembly.
Figure 2B:
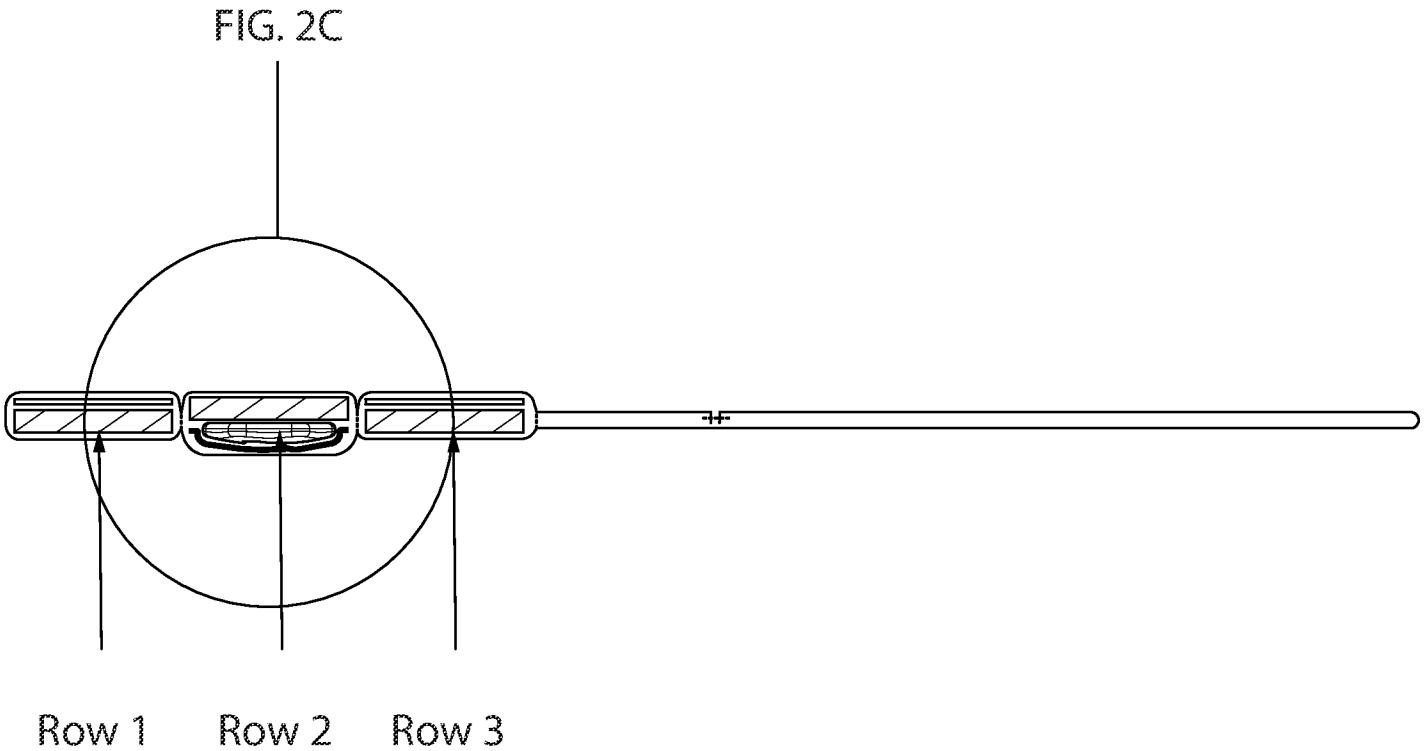
FIG. 2B is a sectional view along line 2B-2B in FIG. 2A.
Figure 2C:
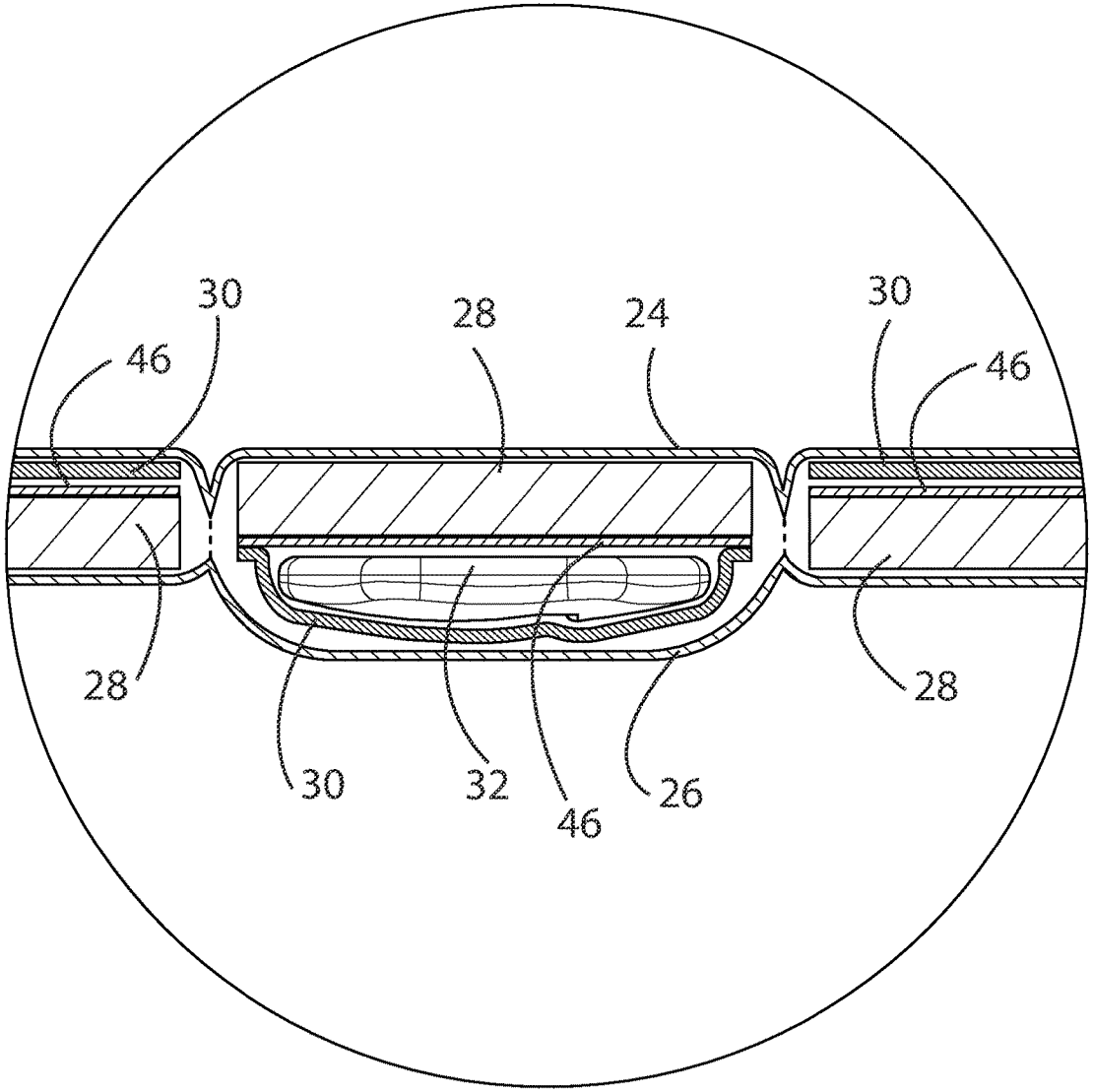
FIG. 2C is a detailed view from FIG. 2B.

Referring to FIGS. 2A, 2B, and 2C, the main portion 12 includes upper and lower fabric layers 24, 26.

In the example illustrated, the main portion 12 includes energy-absorbing layers 28, high-strength strips 30, and armor elements 32. These protective components are arranged between the upper and lower fabric layers 24, 26, and extend generally between the first and second ends 14, 16 of the main portion 12.

In the example illustrated, there is a first row formed of one of the energy-absorbing layers 28 and one of the high-strength strips 30, a second row formed of one of the energy-absorbing layers 28, the armor elements 32, and one of the high-strength strips 30, and a third row formed of one of the energy-absorbing layers 28 and one of the high-strength strips 30. The rows are parallel to each other and extend along the length of the main portion 12 from the first end 14 towards the second end 16. As illustrated, the rows can be offset from the second end 16 of the main portion 12.

In some examples, in the main portion 12, stitching can be provided between the upper and lower fabric layers 24, 26, on either side of each of the rows, to secure the rows in position. Also, in some examples, the armor elements 32 can be adhered to the energy-absorbing layers 28 to secure each of the armor elements in position. Adhesive 46 is shown in FIG. 2C.

In the example illustrated, in the first and third rows, the energy-absorbing layers 28 are adjacent to the lower fabric layer 26 and the high-strength strips 30 are adjacent to the upper fabric layer 24. In the second row, the energy-absorbing layer 28 is adjacent to the upper fabric layer 24, the high-strength strip 30 is adjacent to the lower fabric layer 26, and the armor elements 32 are disposed between the energy-absorbing layer 28 and the high-strength strip 30.

Figure 2D:
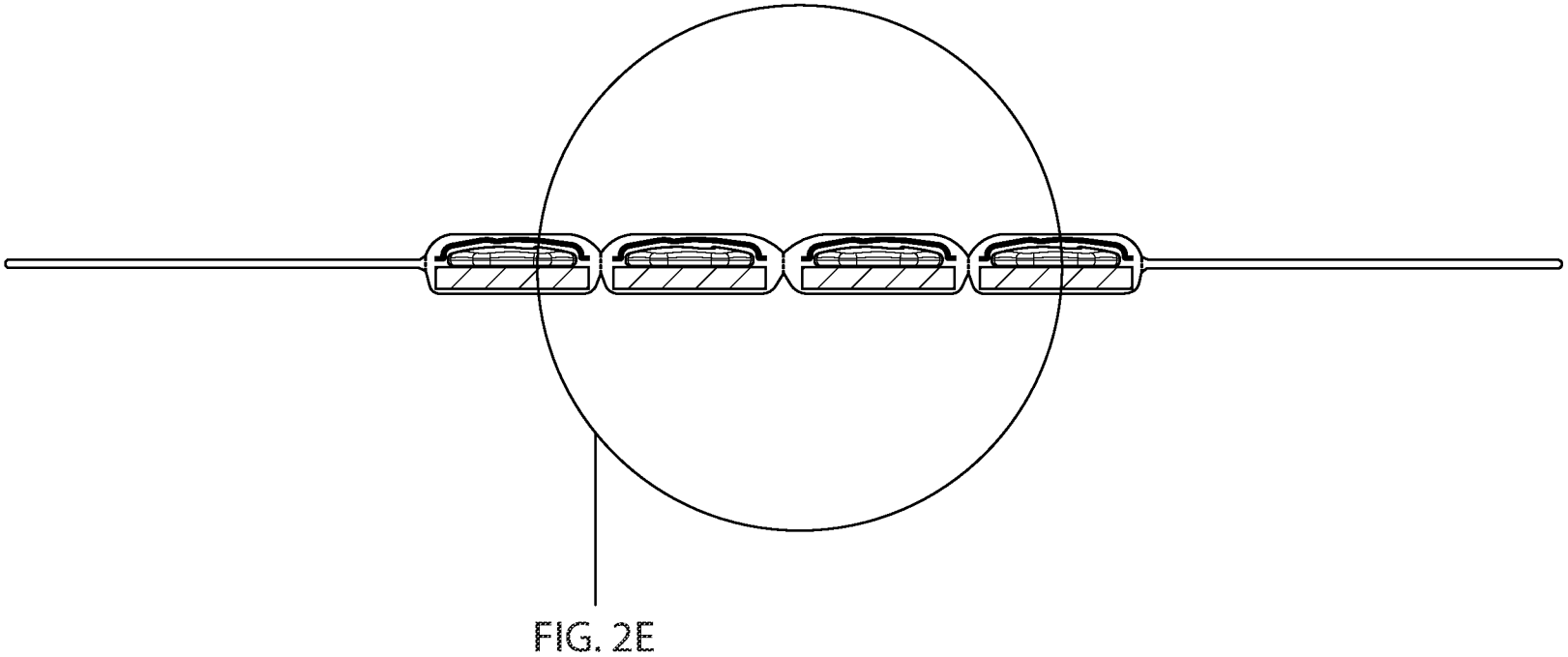
FIG. 2D is a sectional view along line 2D-2D in FIG. 2A.
Figure 2E:
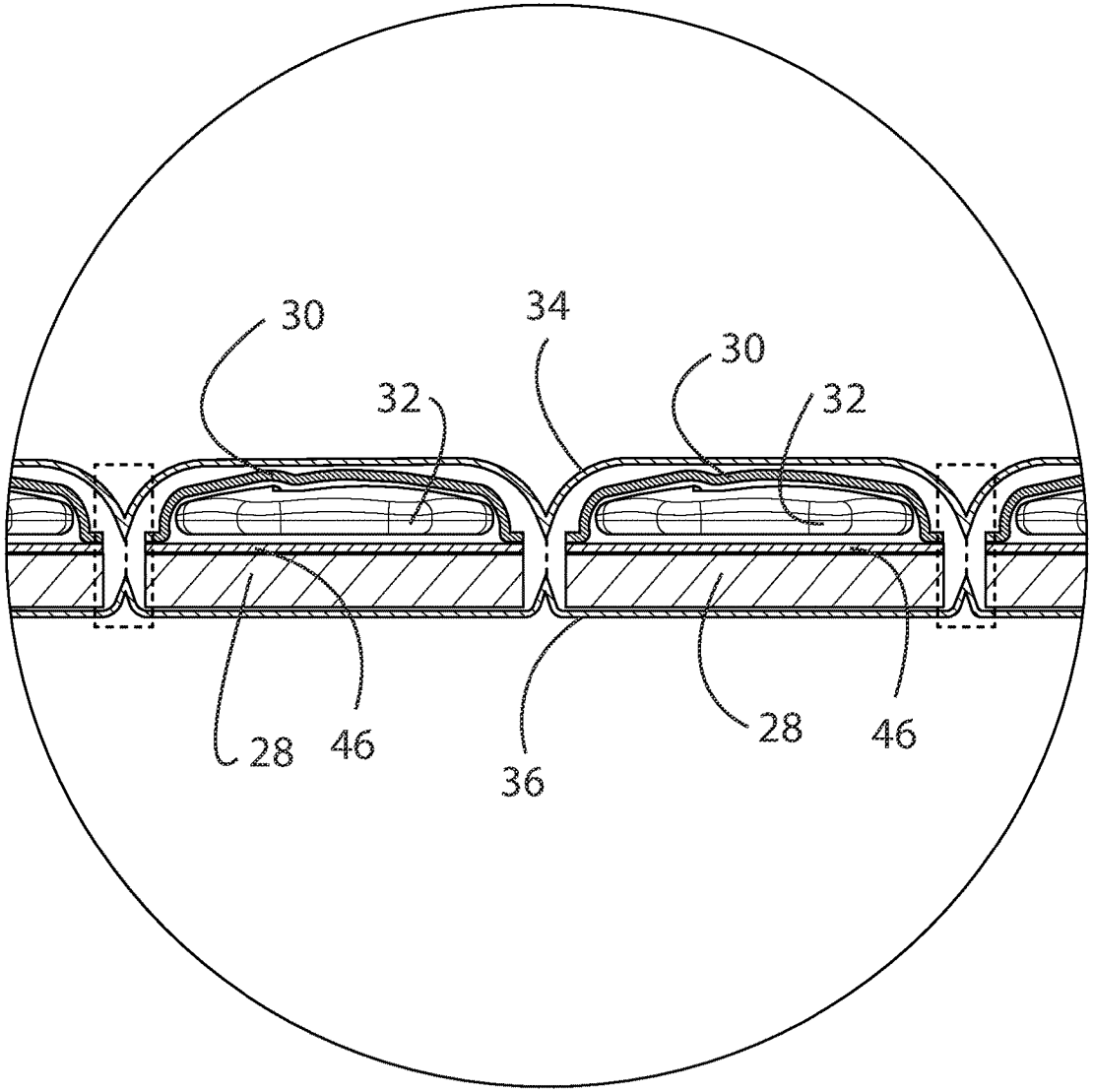
FIG. 2E is a detailed view from FIG. 2D.

Referring to FIGS. 2A, 2D, and 2E, the crown portion 22 includes upper and lower fabric layers 34, 36.

In the example illustrated, the crown portion 22 includes the energy-absorbing layers 28, the high-strength strips 30, and the armor elements 32. These protective components are arranged between the upper and lower fabric layers 34, 36.

In the example illustrated, there four rows each formed of one of the energy-absorbing layers 28, the armor elements 32, and one of the high-strength strips 30. The rows are parallel to each other and are generally centered within the crown portion 22.

In some examples, in the crown portion 22, stitching can be provided between the upper and lower fabric layers 34, 36, on either side of each of the rows, to secure the rows in position. Also, in some examples, the armor elements 32 can be adhered to their respective energy-absorbing layers 28 to secure the armor elements in position. Adhesive 46 is shown in FIG. 2E.

In the example illustrated, in each of the rows, the energy-absorbing layer 28 is adjacent to the lower fabric layer 36, the high-strength strip 30 is adjacent to the upper fabric layer 34, and the armor elements 32 are disposed between the energy-absorbing layer 28 and the high-strength strip 30.

Figure 2F:
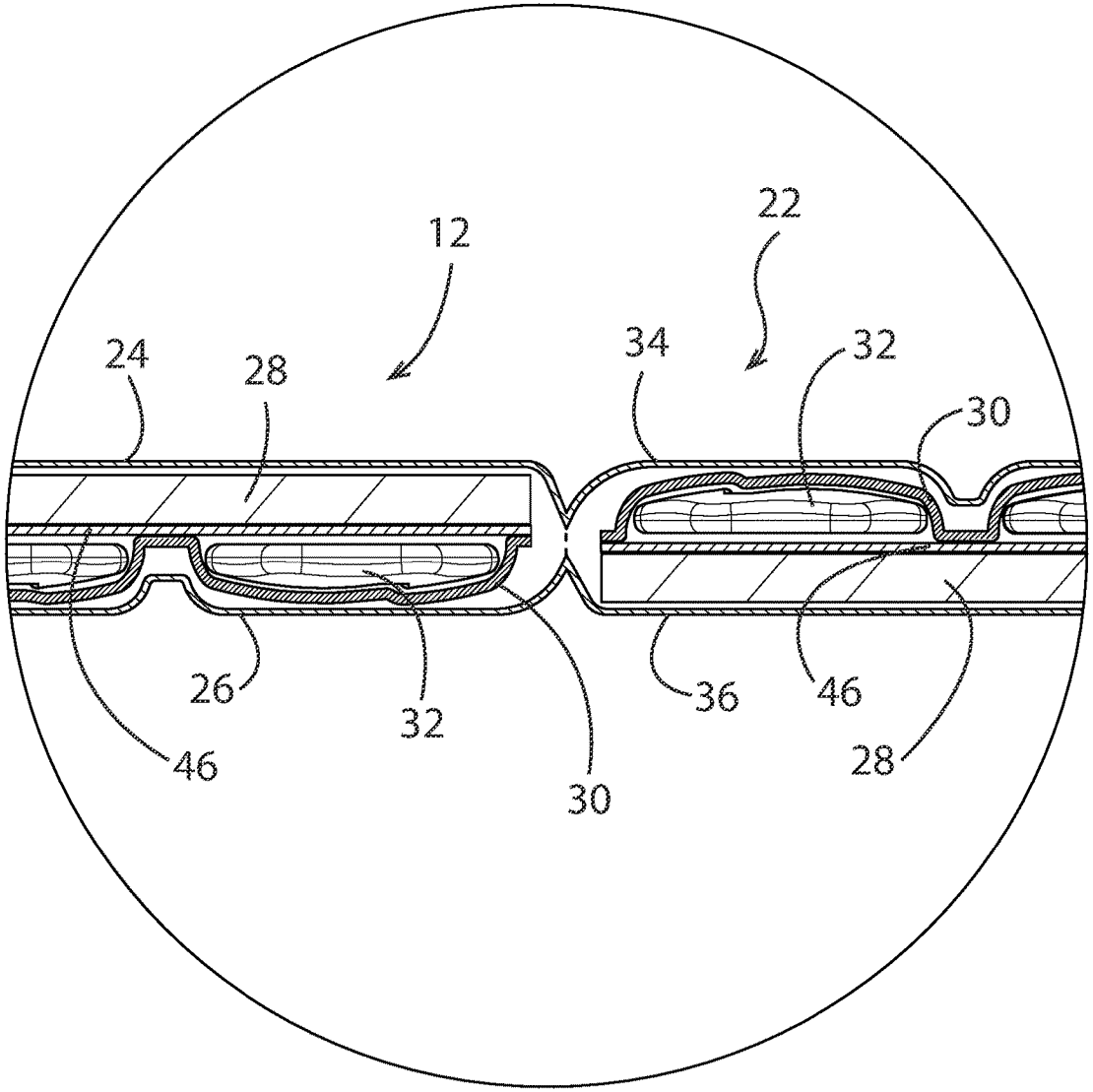
FIG. 2F is a sectional view along line 2F-2F in FIG. 2A.

As shown in FIG. 2F, in some examples, the relative positions of the armor elements 32 can be opposite in the main portion 12 as compared to the crown portion 22. In the main portion 12, the armor elements 32 can face the lower fabric layer 26, whereas in the crown portion 22, the armor elements 32 can face the upper fabric layer 34. This arrangement in the main portion 12 can allow the armor elements 32 to blend better underneath the fabric and be less visible.

Figure 3A:
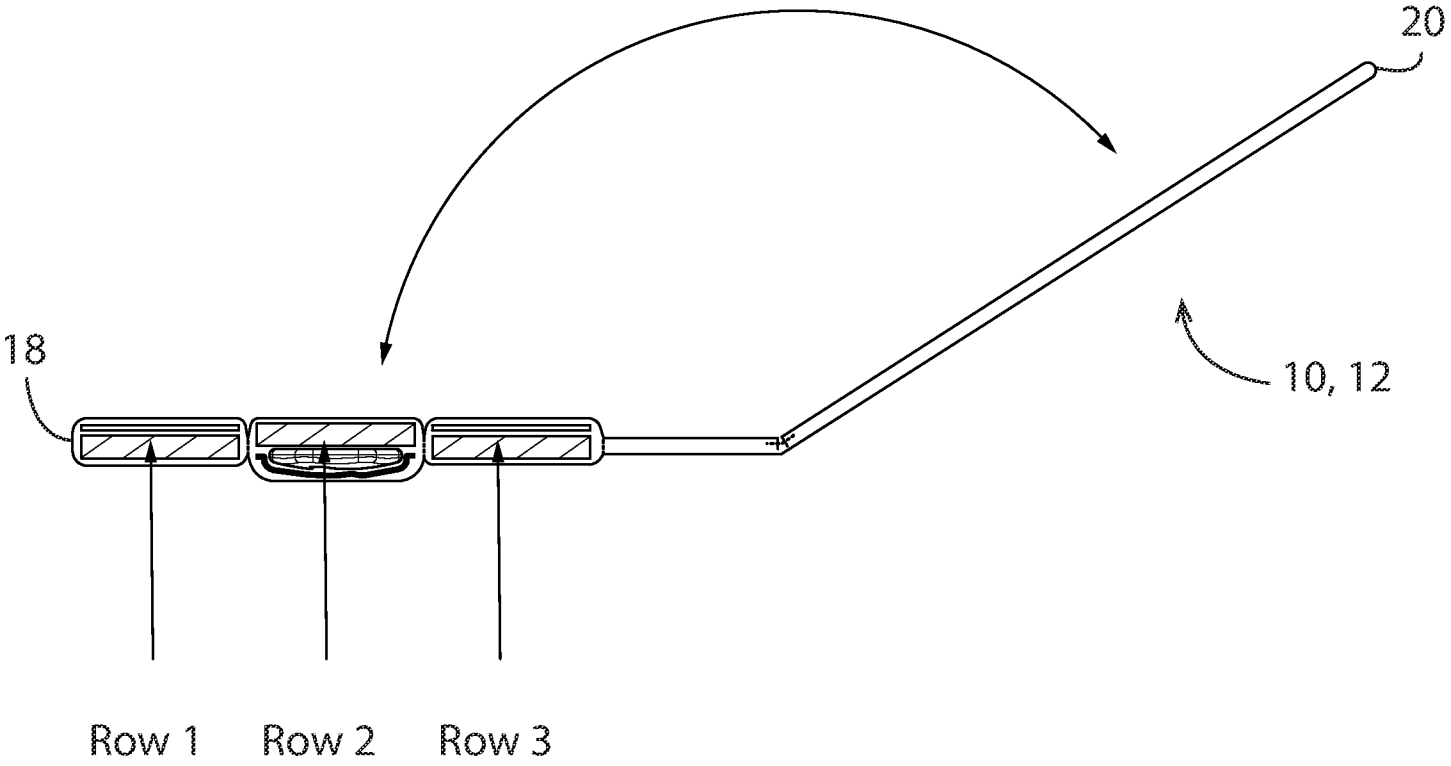
FIG. 3A is another sectional view of the assembly.
Figure 3B:
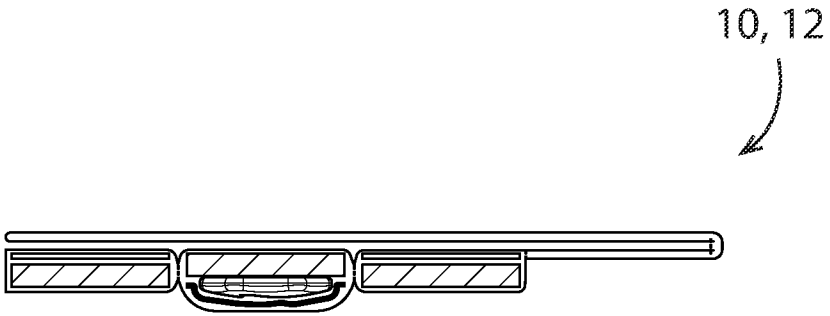
FIG. 3B is another sectional view of the assembly.

As shown in FIG. 3A, the rows can be arranged closer to the first edge 18, so that the energy-absorbing layers 28, the high-strength strips 30 and the armor elements 32 are all disposed between the first edge 18 and a longitudinal centerline of the main portion 12. In such examples, when the main portion 12 is folded in half, all of the protective components reside within the same half, as shown in FIG. 3B.

Figure 4A:
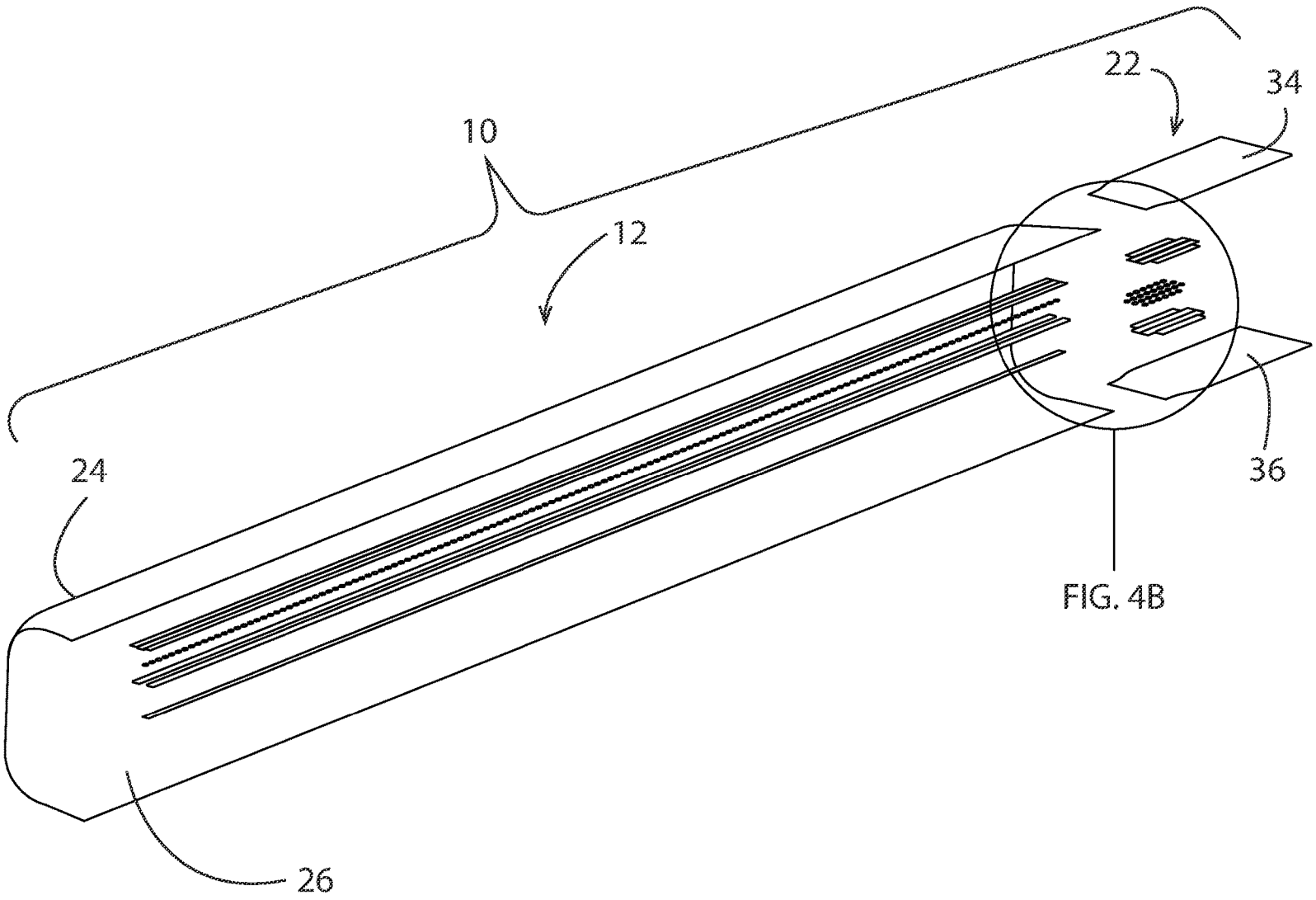
FIG. 4A is an exploded view of the assembly.
Figure 4B:
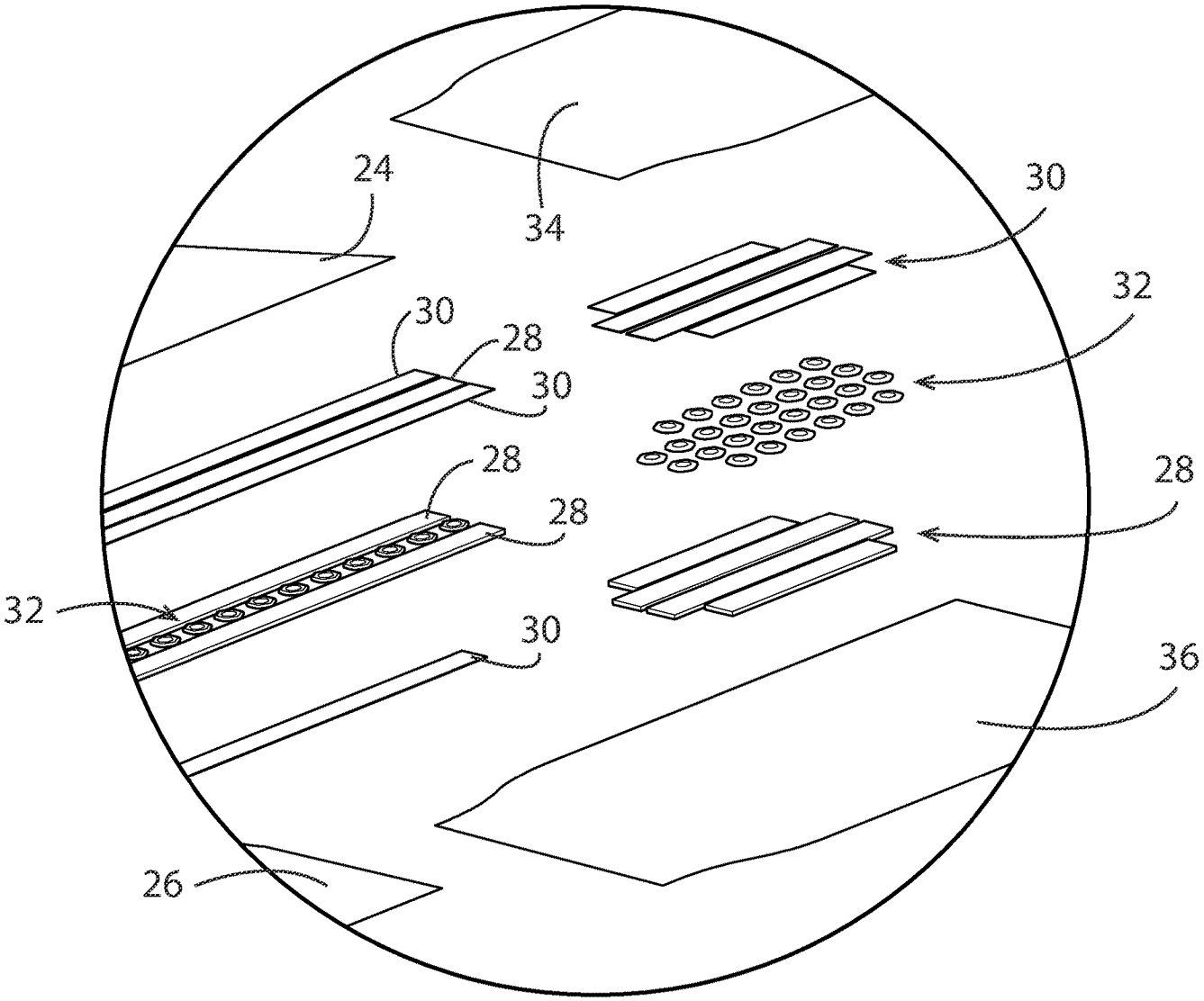
FIG. 4B is a detailed view from FIG. 4A.
Figure 5:
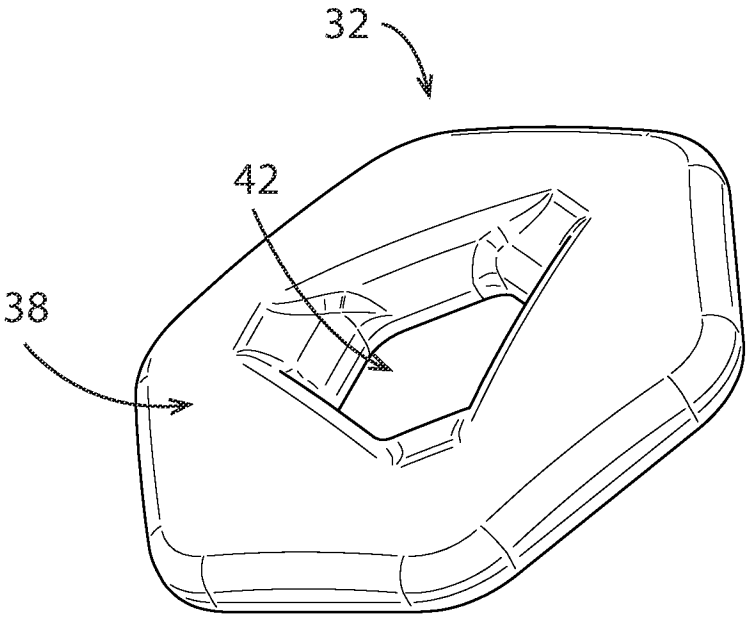
FIG. 5 is a perspective view of an armor element.
Figure 6A:
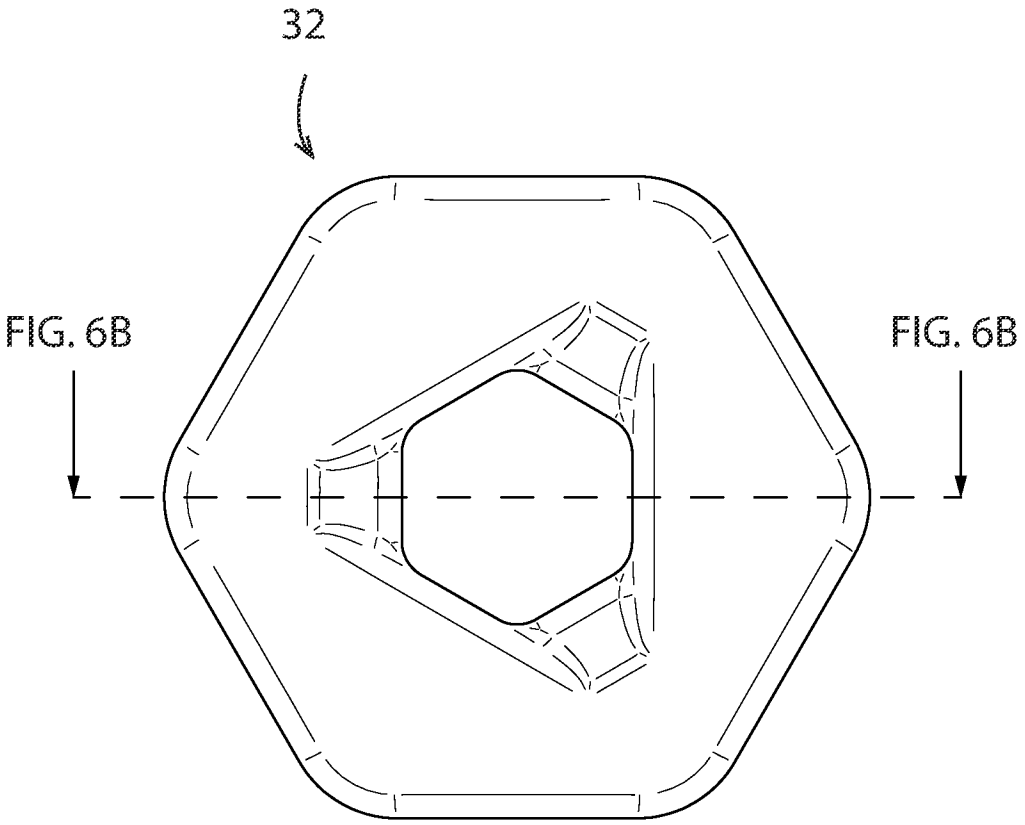
FIG. 6A is a top view of the armor element.
Figure 6B:
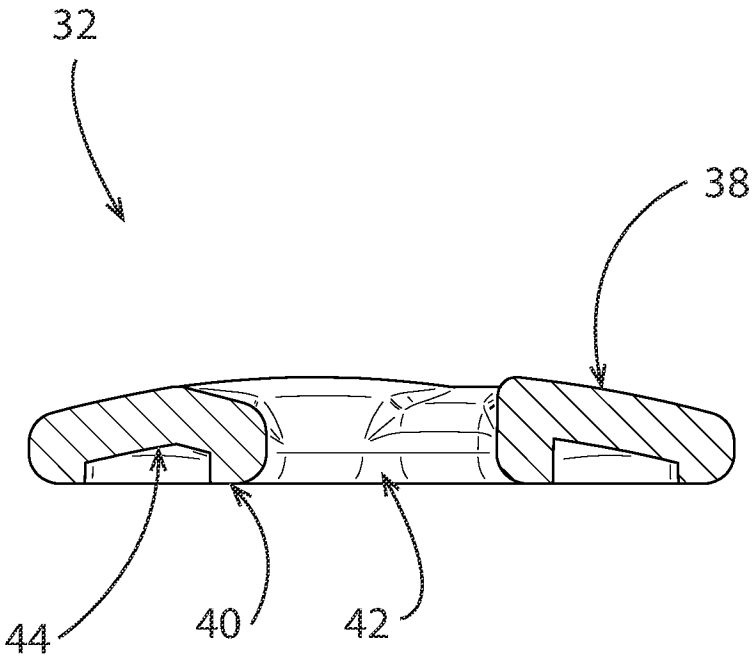
FIG. 6B is a sectional view along line 6B-6B in FIG. 6A.
Figure 7:
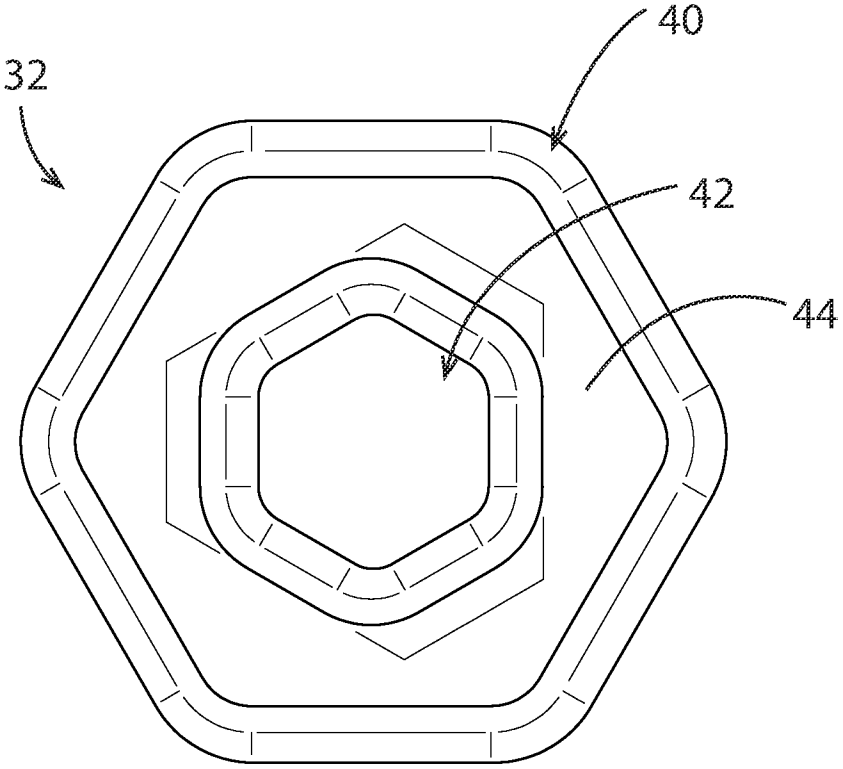
FIG. 7 is a bottom view of the armor element.
Figure 8:
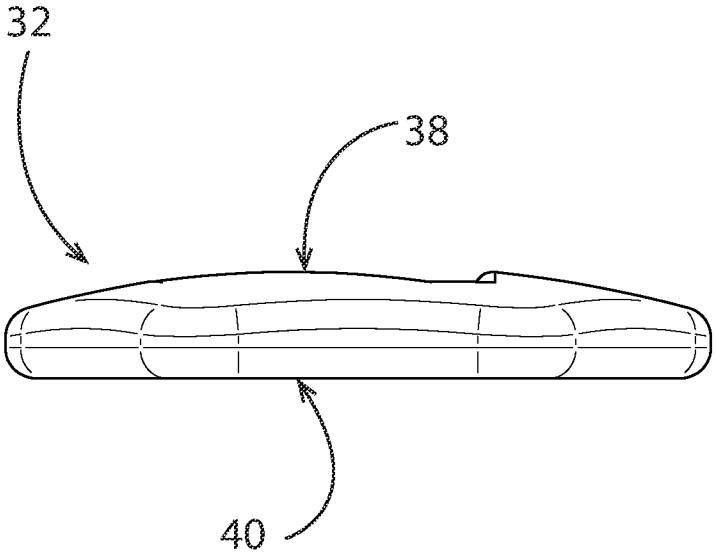
FIG. 8 is a side view of the armor element.

The specific exemplary arrangement of the energy-absorbing layers 28, the high-strength strips 30, and the armor elements 32 within the main and crown portions 12, 22 can be further understood with reference to FIGS. 4A and 4B. In the example illustrated, the layers 24, 26 of the main portion 12 are formed of one piece of fabric, folded roughly in half along its length. It can be seen that, in both portions 12, 22, the armor elements 32 are sandwiched between the energy-absorbing layers 28 and the high-strength strips 30. It can also be seen that the armor elements 32 are arranged spaced apart from one another. As mentioned above, in some examples, the armor elements 32 can be adhered to the energy-absorbing layers 28 to fix them in position.

Referring to FIGS. 5, 6A, 6B, 7 and 8, in the specific example illustrated, the armor element 32 has a domed top surface 38, a flat bottom surface 40, and a general exterior shape that is hexagonal. In some examples, the domed top surface 38 can provide for a smooth outer profile when applied to the person's head, and add strength for each element. In some examples, the flat bottom surface 40 can provide a good surface for adhesion to other materials when bonded into the assembly 10.

In the example illustrated, the outer surfaces of armor element 32 have been rounded to remove any sharp points or edges. The shape of the armor element 32 is selected to allow the matrix of hexagon-like shapes to conform and flex to the contour of the person's head as the assembly 10 is tied. In other examples, armor elements can have a general exterior shape selected from square, rectangle, triangle, rhombus, pentagon, and trapezoid.

In the example illustrated, the armor element 32 includes a central hole 42 and a bottom groove 44 surrounding the central hole 42, recessed relative to the bottom surface 40. The central hole 42 can assist with air flow for breathability of assembly 10. The central hole 42 and the bottom groove 44 can assist with reducing material of the armor element 32.

The resulting structure of the armor element 32 is rigid and lightweight. Implemented into the assembly 10, the armor elements 32 are separate components spaced apart from one another, which can allow flexure and movement, and yet cooperate as a matrix to achieve a "chainmail" protective effect. Spacing can be varied. In the example illustrated, the space between adjacent ones of the armor element is more than the diameter or main dimension of each of the armor elements. In some examples, the space between adjacent ones of the armor element can be less than the diameter or main dimension of each of the armor elements.

Figure 9A:
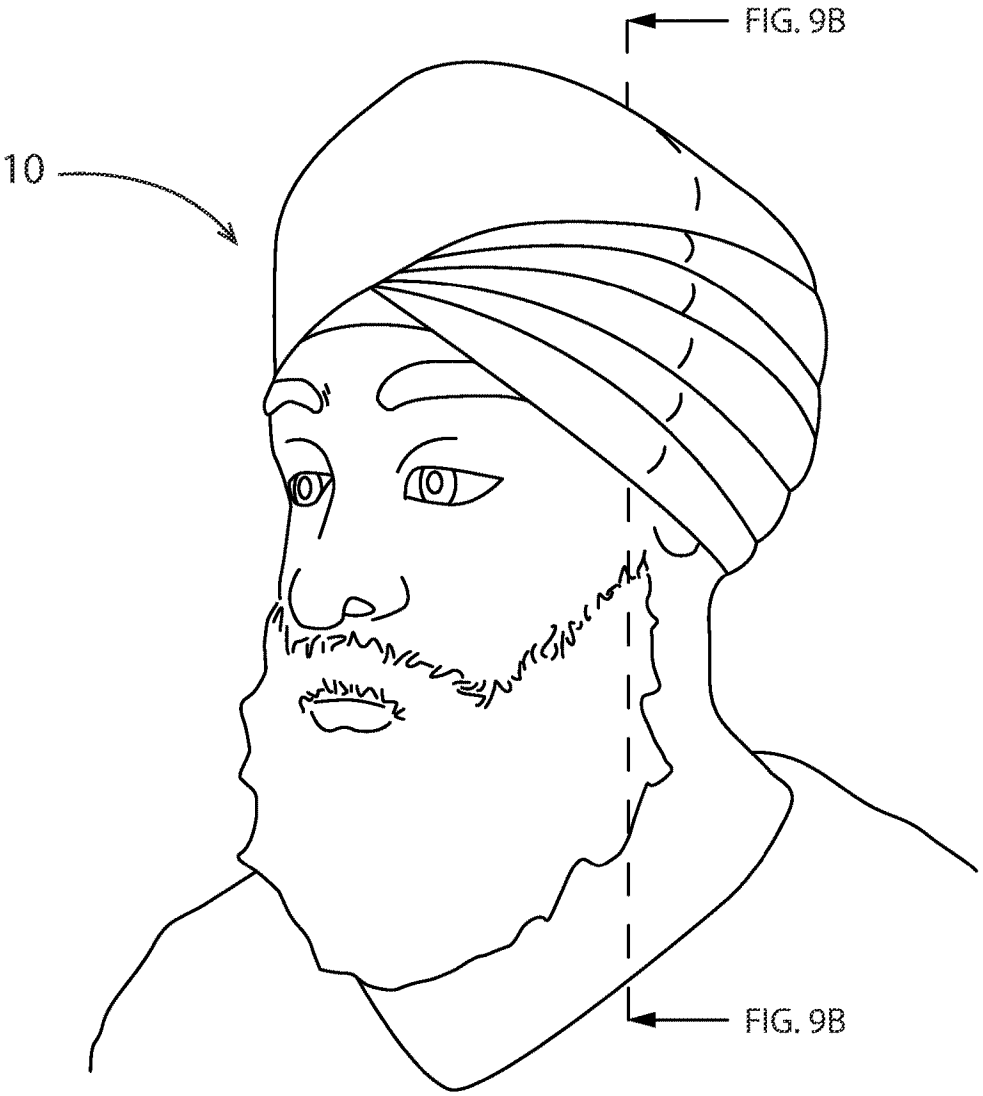
FIG. 9A is a perspective view of a person wearing the protective garment assembly in the form of a turban.
Figure 9B:
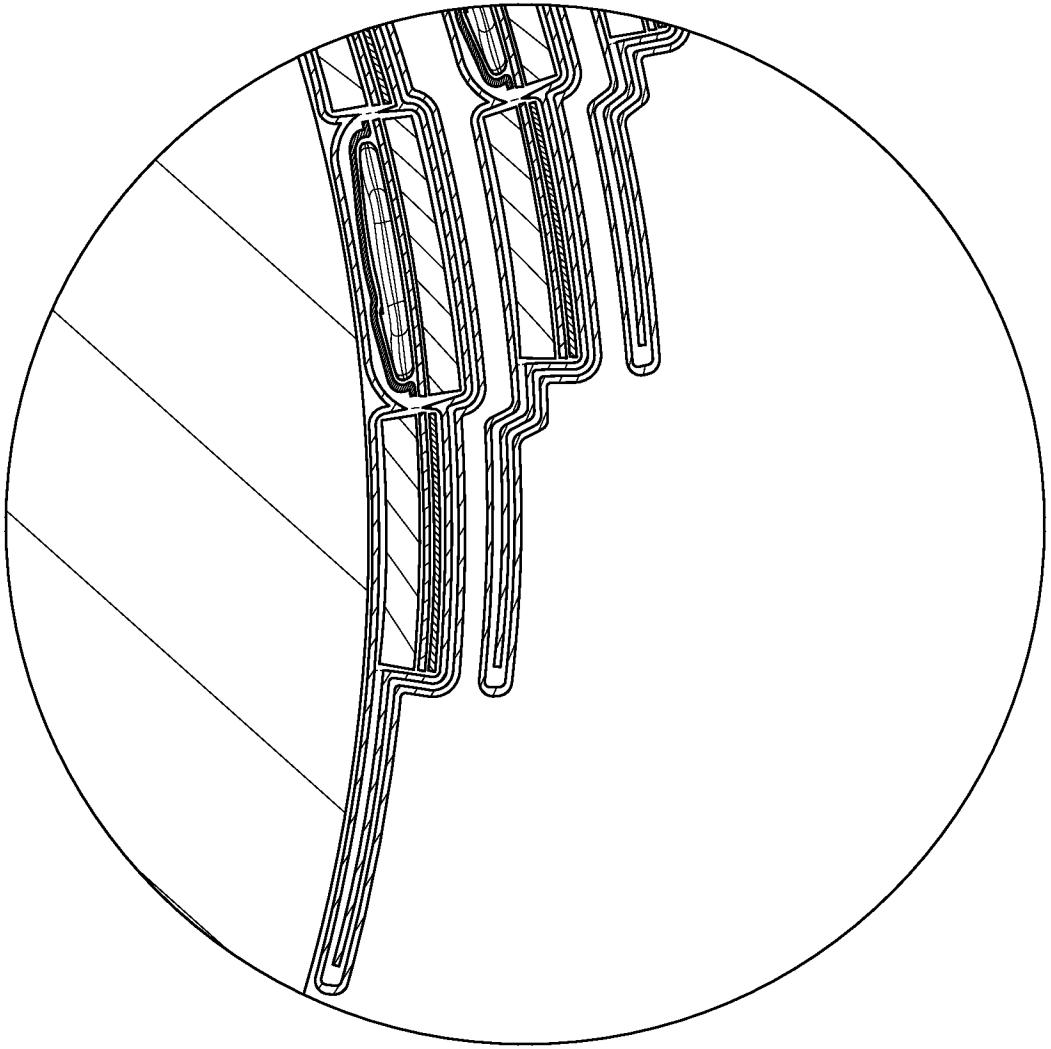
FIG. 9B is a sectional view along line 9B-9B in FIG. 9A.
Figure 10A:
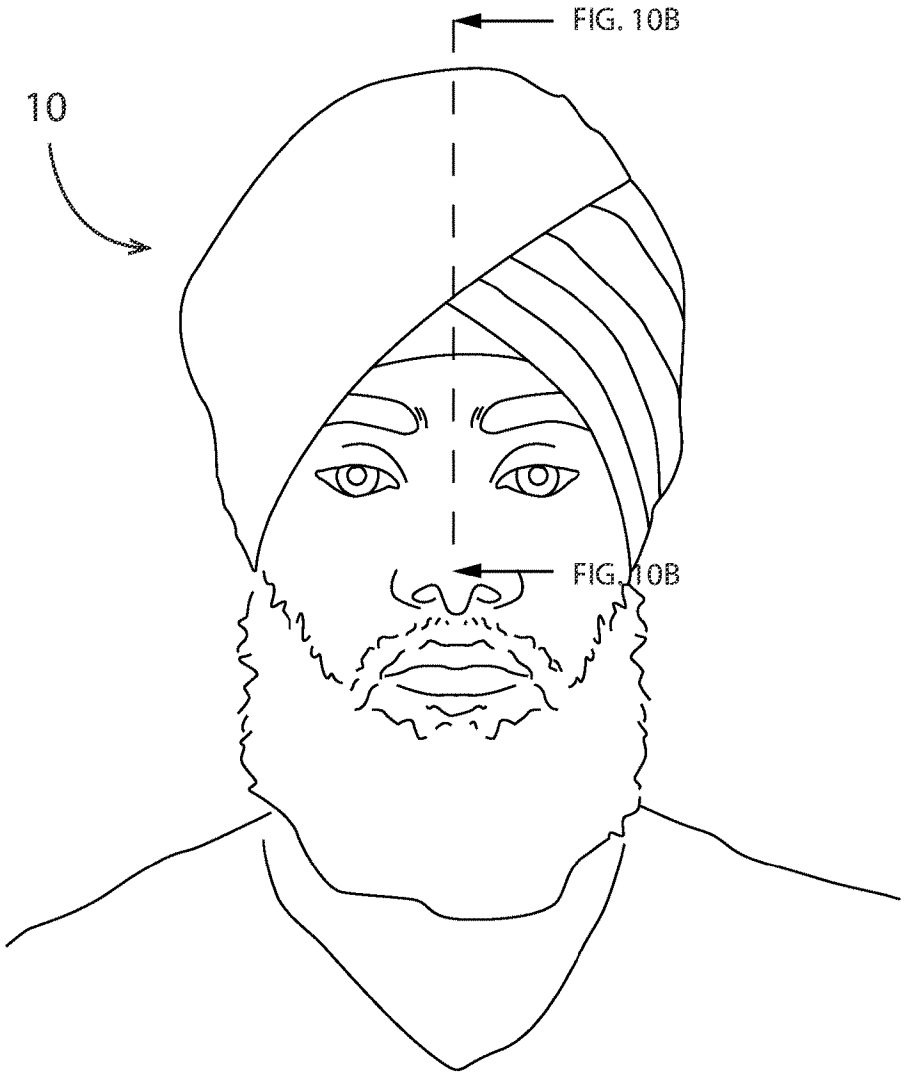
FIG. 10A is a front view of the person wearing the protective garment assembly.
Figure 10B:
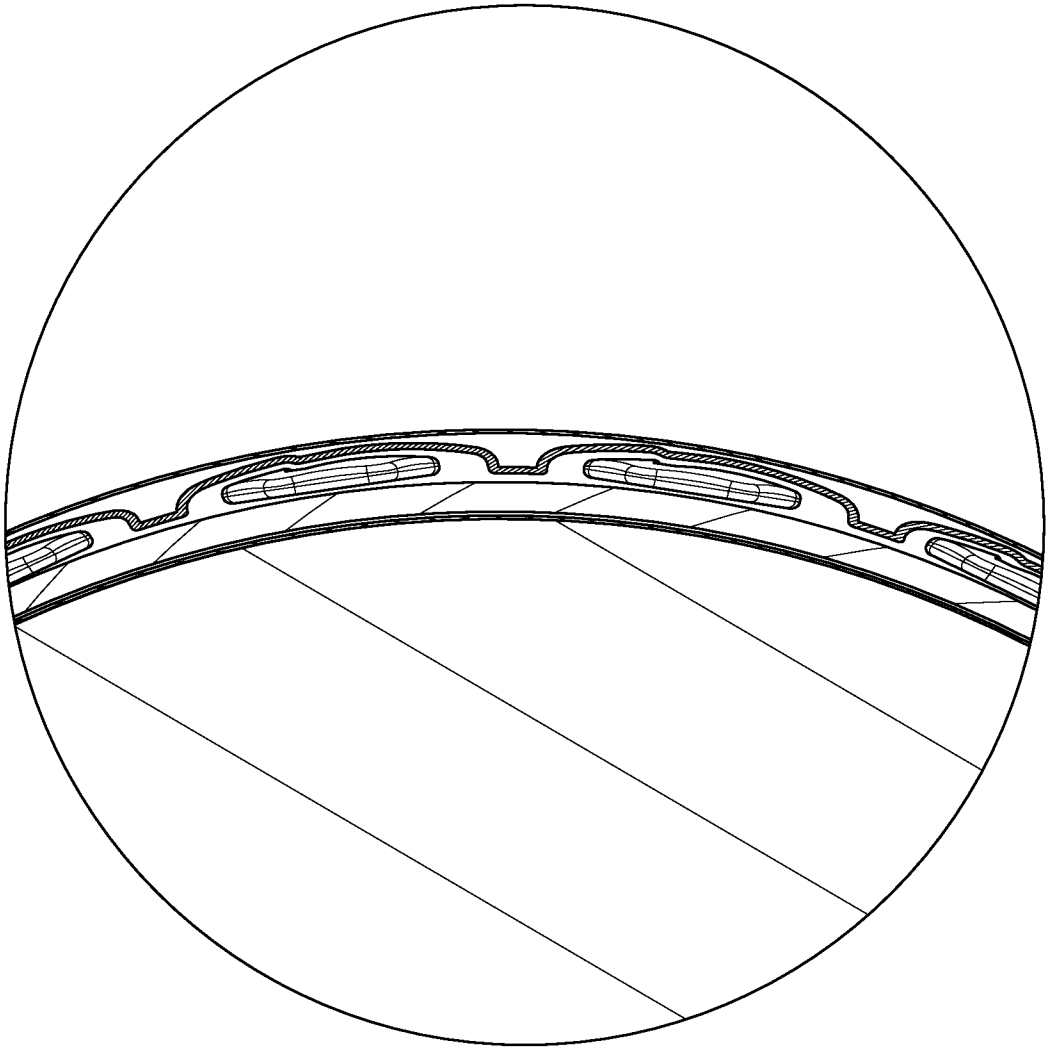
FIG. 10B is a sectional view along line 10B-10B in FIG. 10A.

FIGS. 9A, 9B, 10A and 10B show the wrapped configuration with the assembly 10 being worn by a person as a turban. FIG. 9B shows the side of the person's head, in which the main portion of the assembly 10 has been wrapped progressively to provide tiers of the protective components. Wrapping progressively results in the lower fabric layer of a middle tier is superimposed on the upper fabric layer of an inner tier, and the lower fabric layer of an outer tier is superimposed on the upper fabric layer of the middle tier. Additionally, the middle tier is staggered relative to the inner tier so that a portion of the upper fabric layer of the inner tier is uncovered by the middle tier, and the outer tier is staggered relative to the middle tier so that a portion of the upper fabric of the middle tier is uncovered by the outer tier. FIG. 10B shows the top of the person's head, in which the crown portion of the assembly 10 provides protection.

The following relates to dimensions and materials of the assembly 10, which are intending to be illustrative but non-limiting. It should also be understood that the drawings are schematic in nature and should not be interpreted to express precise dimensions of the assembly 10.

Referring again to FIGS. 1, 4A and 4B, the length and width of the main portion 12 can be approximately 168" (3762 mm) and approximately 8" (202 mm), respectively. The crown portion 22 can be approximately 20" (508 mm)

long by 10" (254 mm) wide. Each of the rows can be offset from the second end 16 of the main portion 12 by approximately 16" (406 mm), which can be helpful if the second end 16 needs to be tucked in to secure the assembly 10 around a person's head.

In some examples, the fabric layers 24, 26, 34, 36 can be formed of rubia voile 100% cotton material. This can be a soft, light and durable material, and its use can give the assembly 10 a look and feel that resembles a typical Sikh turban. In a prototype, the inventors used fabric that is 0.0091" (0.23 mm) thick.

In some examples, the energy-absorbing layers 28 can be formed of a non-Newtonian foam material, e.g., D30® material and/or Poron® XRD™ material. These materials can start out soft and flexible, but stiffen when force is applied, to disperse impact. In a prototype, the inventors used strip foam (McMaster Carr part #93275K117 or 86375K262) that is 1/16" (1.6 mm) thick.

In some examples, the high-strength strips 30 can be formed of a high-strength fabric with tear resistance, e.g., Dyneema® composite fabric material. In a prototype, the inventors used fabric that is 0.0023" (0.06 mm) thick (Ripstop by the Roll LLC, 0.8 oz Dyneema® Composite Fabric CT2E.08).

The armor elements 32 can be formed of various materials, including plastic materials such as acrylonitrile butadiene styrene (ABS), polycarbonate, Delrin®, and glass-reinforced nylon. The armor elements can also be formed of carbon composite materials. In a prototype, the inventors used 3D-printed ABS that is 0.11" (2.81 mm) thick, 0.74" (18.67 mm) across, 0.014 oz (0.4 g) in weight, and these armor elements were spaced apart approximately 1" (25.4 mm) from each other. In other examples, armor elements can be formed by casting of polycarbonate, or carbon composite.

While the above description provides examples of one or more apparatuses or methods, it will be appreciated that other apparatuses or methods may be within the scope of the accompanying claims.

We claim:

1. A protective garment assembly, comprising: an elongate main portion having a length that extends between first and second ends, the main portion comprising an upper fabric layer and a lower fabric layer; at least one energy-absorbing layer arranged between the upper and lower fabric layers and extending at least partially between the first and second ends; at least one high-strength strip arranged between the upper and lower fabric layers adjacent to the at least one energy-absorbing layer; and a plurality of armor elements arranged between the upper and lower fabric layers adjacent to the at least one energy-absorbing layer and the at least one high-strength strip, wherein the plurality of armor elements are adhered to the at least one energy-absorbing layer;

the assembly having an unwrapped configuration and a wrapped configuration, the wrapped configuration comprising the main portion of the assembly wrapped progressively and overlappingly such that the lower fabric layer of a middle tier is superimposed on the upper fabric layer of an inner tier, and the lower fabric layer of an outer tier is superimposed on the upper fabric layer of the middle tier, wherein the wrapped configuration is configured to be worn on a person's head as a turban and wrapped around the person's head to provide tiers of protection.

2. The assembly of claim 1, wherein the plurality of armor elements are disposed between the at least one energy-absorbing layer and the at least one high-strength strip.

3. The assembly of claim 2, wherein the plurality of armor elements are spaced apart from one another.

4. The assembly of claim 3, wherein each of the armor elements has a general exterior shape that is a hexagon.

5. The assembly of claim 4, wherein each of the armor elements has a domed top surface and a flat bottom surface.

6. The assembly of claim 5, wherein each of the armor elements comprises a central hole and a bottom groove surrounding the central hole.

7. The assembly of claim 1, wherein the main portion has a width that extends between first and second edges, and each of the at least one energy-absorbing layer, the at least one high-strength strip and the plurality of armor elements is disposed between the first edge and a longitudinal centerline of the main portion.

8. The assembly of claim 1, comprising:

a first row formed of one of the energy-absorbing layers and one of the high-strength strips;

a second row parallel to the first row and formed of one of the energy-absorbing layers, the plurality of armor elements, and one of the high-strength strips; and a third row parallel to the second row and formed of one of the energy-absorbing layers and one of the high-strength strips.

9. The assembly of claim 8, wherein each of the rows is offset from the second end of the main portion.

10. The assembly of claim 9, wherein, in the first and third rows, the energy-absorbing layer is arranged adjacent to an inner surface of the main portion and the high-strength strip is arranged adjacent to an outer surface of the main portion, and in the second row, the energy-absorbing layer is arranged adjacent to the outer surface and the high-strength strip is arranged adjacent to the inner surface.

11. The assembly of claim 1, comprising a crown portion secured to the first end of the main portion, the crown portion comprising:

an upper fabric layer and a lower fabric layer;

at least one energy-absorbing layer arranged between the upper and lower fabric layers;

at least one high-strength strip arranged between the upper and lower fabric layers adjacent to the at least one energy-absorbing layer; and a plurality of armor elements arranged between the upper and lower fabric layers adjacent to the at least one energy-absorbing layer and the at least one high-strength strip, wherein the crown portion of the assembly is configured to provide protection to a top of the person's head.

12. The assembly of claim 11, wherein the crown portion comprises four rows arranged in parallel to and alongside one another, each of the rows formed of one of the energy-absorbing layers, a portion of the plurality of armor elements, and one of the high-strength strips.

13. The assembly of claim 12, wherein, in each of the rows of the crown portion, the energy-absorbing layer is arranged adjacent to an inner surface of the crown portion and the high-strength strip is arranged adjacent to an outer surface of the crown portion.

14. The assembly of claim 1, wherein the upper and lower fabric layers are formed of rubia voile 100% cotton material.

15. The assembly of claim 1, wherein the at least one energy-absorbing layer is formed of a non-Newtonian foam material.

16. The assembly of claim 1, wherein the at least one high-strength strip is formed of a high-strength fabric.

17. The assembly of claim 16, wherein the high-strength fabric comprises a sheet of ultra-high-molecular-weight polyethylene.

18. The assembly of claim 1, wherein each of the armor elements is formed of a plastic material and/or a carbon composite material.

19. The assembly of claim 1, wherein the middle tier is staggered relative to the first inner tier so that a portion of the upper fabric layer of the inner tier is uncovered by the middle tier, and the outer tier is staggered relative to the middle tier so that a portion of the upper fabric layer of the middle tier is uncovered by the outer tier.

* * * * *